US005743277A

United States Patent [19]

Moreshead

[11] Patent Number: 5,743,277

[45] Date of Patent: Apr. 28, 1998

[54] DEVICE AND METHOD FOR FORMING ARTIFICIAL NAILS

[76] Inventor: Cynthia L. Moreshead, 42 Pine Acres Rd., Foxboro, Mass. 02035

[21] Appl. No.: 614,967

[22] Filed: Mar. 11, 1996

Related U.S. Application Data

[60] Provisional application No. 60/007,763 Nov. 30, 1995.

[51] Int. Cl.[6] ..... A45D 29/00

[52] U.S. Cl. ..... 132/200; 132/285

[58] Field of Search ..... 132/200, 73, 285, 132/73.5, 76.5, 319, 76.2, 76.4

[56] References Cited

U.S. PATENT DOCUMENTS

| | | | |
|---|---|---|---|
| 2,262,977 | 11/1941 | Vasil | 132/285 |
| 2,485,384 | 10/1949 | Klein | 132/285 |
| 2,654,375 | 10/1953 | Krank et al. | 132/285 |
| 2,799,282 | 7/1957 | Slack . | |
| 3,245,418 | 4/1966 | Dinerstein . | |
| 4,172,461 | 10/1979 | Pangburn . | |
| 4,287,899 | 9/1981 | Robichaud | 132/73 |
| 4,643,208 | 2/1987 | Amour . | |
| 4,682,612 | 7/1987 | Giuliano . | |
| 4,924,889 | 5/1990 | Schaeffer et al. . | |

*Primary Examiner*—Todd E. Manahan
*Assistant Examiner*—E. Robert
*Attorney, Agent, or Firm*—Richard P. Crowley

[57] ABSTRACT

A device and method for forming an artificial finger nail of varying configurations from a nail coating composite of liquid composition, hardenable to form a hard substance, deposited in one of a set of mold inserts for controlling contour and shape of a sculptured nail. The device includes a set of mold inserts consisting of at least one selected mold insert and adapted to be slidably mounted in a frame for controlling positioning of an insert relative to a finger nail of a user. The device includes a frame with an arcuate base having a coplanar arcuate retainer with a guide for supporting the selected mold insert and arranged to form an elongated reservoir for receiving the nail coating composition superimposed on the nail of a user. The contour and shape of a sculptured nail so formed is determined by the configuration of the selected mold insert slid in the frame.

27 Claims, 6 Drawing Sheets

DEVICE AND METHOD FOR FORMING ARTIFICIAL NAILS

REFERENCE TO PRIOR APPLICATIONS

This application is based on and claims the benefit of the priority date of provisional application Ser. No. 60/007,763, filed Nov. 30, 1995, hereby incorporated by reference.

BACKGROUND OF THE INVENTION

The present invention relates generally to methods and apparatuses for applying a coating of liquid composition to a finger nail wherein said composition is hardenable to form a hard, artificial nail, such as an acrylic artificial nail. The molding of artificial nails of sculptured, elongated configuration also may be conducted by a device wherein the composition is deposited on a finger nail positioned in a well surrounded by a mold of preselected configuration having a selected shape and length.

BACKGROUND ART

Artificial nails are well known and are commonly employed by people who desire the appearance of longer nails. Devices have been developed to form the desired artificial nail. One such device is shown in U.S. Pat. No. 4,682,612 which discloses a device for forming nails having a well or reservoir in the shape of the desired artificial nail. Devices of the type exemplified by U.S. Pat. No. 4,682,612 are not without their drawbacks. As a matter of nature, each person's nails and their desire for artificial nails are different. As such, some people desire short artificial nails, while others desire longer artificial nails. Devices of the type exemplified by U.S. Pat. No. 4,682,612 provide a fixed well or reservoir, which thereby fixes the length and shape of the artificial nail, and consequently, cannot be used to form artificial nails of varying shapes and lengths.

Despite the teachings of the prior art, there has not been a device or method of forming artificial nails of varying configurations, integrating control and associated speed of application of a mold for forming hardenable coatings, which mold can be varied in shape and length. Individual preference for nail size and shape varies, as well as individual nail shapes. Thus, the successful artificial nail device, and a method for forming artificial nails employing the device, requires flexibility in the type of shape and length of nail mold provided for selection by a user.

Accordingly, it is desirable to provide for a new and improved device and method for forming artificial nails of varying configurations incorporating a changeable mold insert. This device integrates greater control and associated speed of application by employing the changeable mold insert for forming a hardenable coating, which can be varied in shape and length to provide for greater individual preference, and which overcomes at least some of the disadvantages of the prior art.

SUMMARY OF THE INVENTION

The present invention relates to an artificial nail-forming device and method of use in forming artificial nails.

The present invention relates to a method and apparatuses for the setting of a layer of artificial nail coating comprising, in combination, an artificial nail coating composition of liquid composition, hardenable to form a hard substance, and mold means for receiving nail coating composition and selectively forming artificial nails of variable configuration. The invention further relates to a method of forming artificial nails of varying configurations, integrating the control and associated speed of application of a molding device for forming a hardenable coating. The present invention permits artificial nail formation by incorporation of a frame for receiving slidable mold inserts of selected dimensions, and by the application of its changeable sets of mold inserts. For example, the shape of the nail can be varied from an oval form to a round form with a length varied from small to medium to elongated.

The device for forming an artificial finger nail of varying configurations comprises an insert means for controlling contour and shape of the sculptured nail, adapted to receive said nail coating composition, comprising at least one mold insert of a set of mold inserts consisting of a plurality of mold inserts each having a varied contour and shape. The device includes a frame member for positioning of a selected mold insert relative to a user's finger nail, the frame having a distal end comprising an arcuate base for engaging a finger. The frame member is constructed of a malleable material capable of being shaped to the user's finger, and the frame member is characterized by a window aperture for surrounding said finger nail. A guide means for slidably supporting said insert means, comprising a coplanar arcuate retainer, is positioned at the distal end of said frame apparatus, wherein the insert means is slidably mounted in the frame in engagement with said guide means, and configured to associate with the window aperture to form an elongated reservoir for receiving an artificial nail coating composition superimposed on the nail of a user. The contour and shape of a sculptured nail formed by the frame is varied by varying the shape and contour of the mold insert selected.

In particular, the present invention is directed to a device for forming artificial nails of varying configurations employing one or preferably sets of a plurality of changeable mold inserts of curved configuration, one insert of which is mounted in a frame for forming a hardenable coating which can be varied in shape and length. Selection of the one insert from the sets of changeable mold inserts, wherein each insert is of variable configuration, is made according to individual aesthetic preference, as well as individual hand and finger shape. The frame device incorporates an arcuate base for positioning on a finger or thumb nail for receiving a selected one of a changeable set of curved mold inserts, typically in a slidable, removable, changeable relationship. By changing the mold insert, the shape of the nail formed by the hardening of a coating of liquid composition can be varied from an oval form to a round form, with a length varied from small to medium to elongated.

The present invention also includes a method for applying a coating of liquid composition to a finger nail, wherein said composition is hardenable to form a preselected sculptured artificial nail, such as an acrylic artificial nail. As practiced by this method, the molding of artificial nails of varying lengths and shapes by means of a preformed mold insert integrates control of forming liquid coating on a finger nail as well as associated speed of application, particularly for an unskilled operator. As practiced by this method, the composition is deposited on a finger nail positioned in a well or reservoir surrounded by a mold consisting of a mold insert of preselected configuration slid or positioned in place on the form and having a selected shape and length. This new and improved device provides improved control and associated speed of application utilizing a changeable mold insert. Individuals may practice the art of applying artificial nails according to their own individual preference in a timely and efficient manner. With the device and method, the length and shape of an artificial nail can be easily selected as desired and can be varied by inserting a differently shaped mold insert member.

The frame and insert are characterized as having a defined open area adapted for receiving the coating composition, said area being in the general shape and size of the desired nail extension, thereby making it easy to apply the necessary amount of liquid in the right place, minimizing the shaping that is required as well as avoiding the application of excess liquid. In one preferred embodiment, the defined area of receiving the coating composition is a well-defined reservoir formed by the association of a mold insert and a window aperture in an arcuate base member of the frame. The mold inserts for slidable insertion in one open end of the frame device are provided in a single, or preferably sets, of differing configuration and shape, which permit adjustment of the shape and size of the defined liquid-receiving area.

The primary object of the present invention is to provide a device which can be used to form artificial nails of varying lengths and shapes.

Another object of the present invention is to provide a device which can be used in forming artificial nails which integrates control and associated speed of application of a molding device for forming a hardenable coating.

Other objects, advantages and novel features and further scope of applicability of the present invention will be set forth in part in the detailed description to follow taken in conjunction with the accompanying drawings, and in part will become apparent to those skilled in the art upon examination of the following, or may be learned by practice of the invention.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

FIG. 3A is a perspective view of the invention of FIG. 1 showing one of a set of mold inserts configured with a round form with an elongated length;

FIG. 3B is a perspective view of the invention of FIG. 1 showing one of a set of mold inserts configured with a round form with a medium length;

FIG. 3C is a perspective view of the invention of FIG. 1 showing one of a set of mold inserts configured with a round form with a small length;

FIG. 4A is a perspective view of the invention of FIG. 1 showing one of another set of mold inserts configured with an oval form with an elongated length;

FIG. 4B is a perspective view of the invention of FIG. 1 showing one of another set of mold inserts configured with an oval form with a medium length;

FIG. 4C is a perspective view of the invention of FIG. 1 showing one of another set of mold inserts configured with an oval form with a small length;

DETAILED DESCRIPTION OF THE PREFERRED EMBODIMENT

Figure 1:
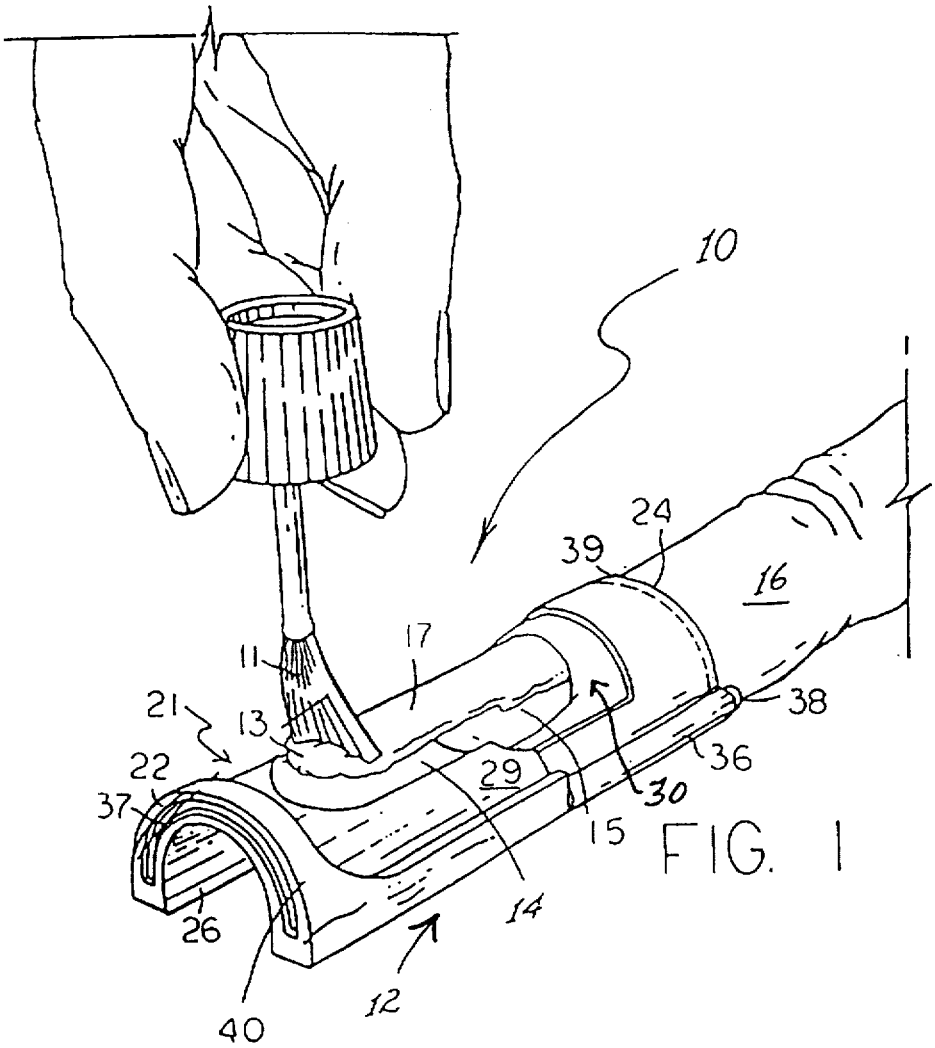
FIG. 1 is a perspective view of the present invention shown positioned on a user's finger wherein the device is shown positioned to receive nail coating and to sculpture a nail of a desired length and shape.
Figure 2:
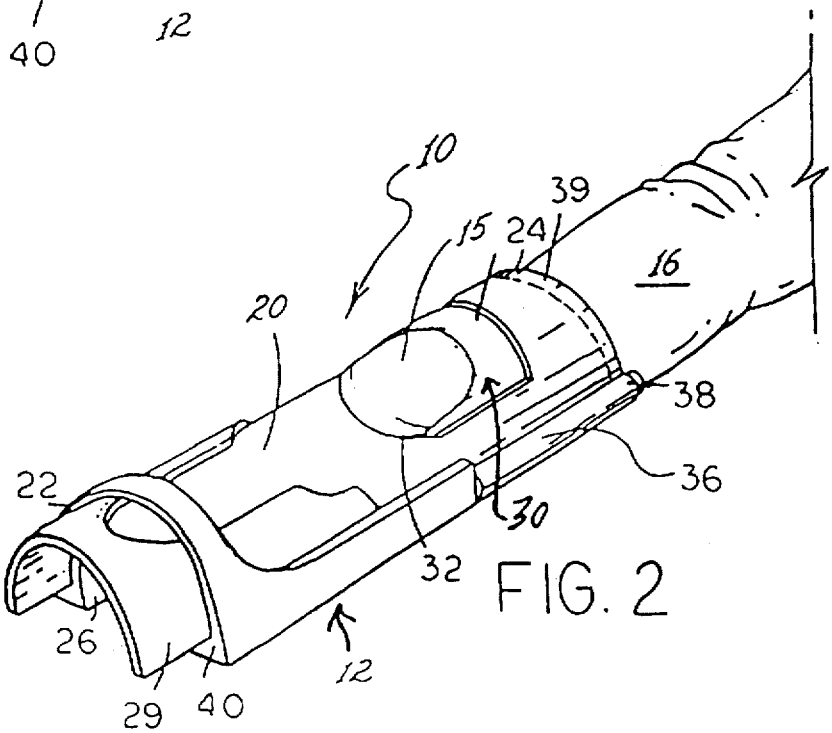
FIG. 2 is a perspective view of the invention of FIG. 1 with a mold insert shown partially inserted in the frame apparatus.

Referring to FIGS. 1–7, there is shown a nail-forming device 10 generally comprising a frame member 12 which is adapted to be mounted on a user's finger 16 adjacent a nail 15. The device 10 further comprises at least two sets of mold inserts consisting of a round set 21 (FIGS. 3A, 3B and 3C) and an oval set 23 (FIGS. 4A, 4B and 4C). In FIGS. 1 and 2, an insert 29 from round insert set 21 is slidably positioned within the frame member 12 to thereby form a reservoir 14 for accepting the deposit of nail coating composition 13 provided by applicator 11, as shown in FIG. 1, to form a sculptured artificial nail 17 of a selected length and shape.

Figures 3A, 3B, 3C:
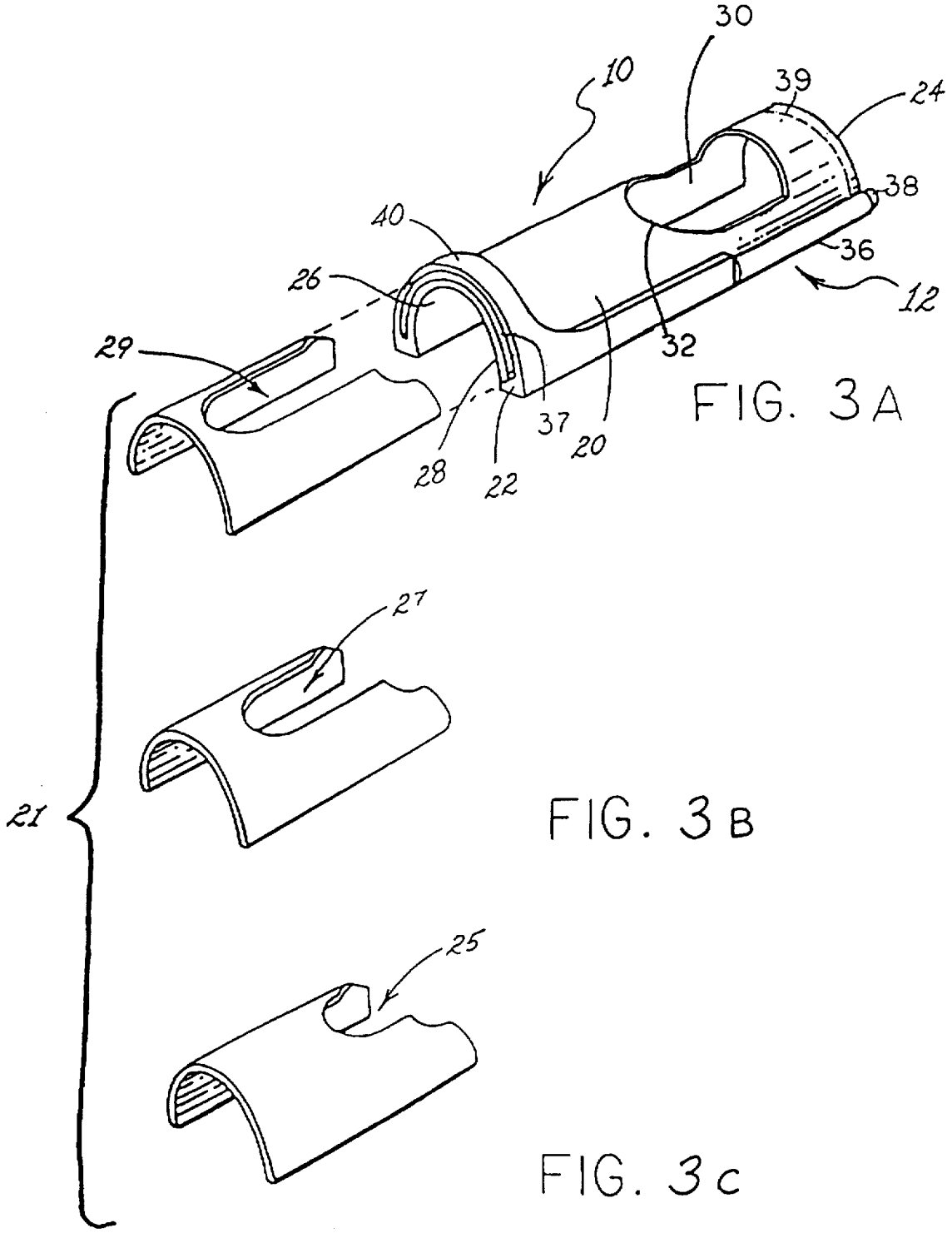
FIGS. 3A, 3B and 3C are perspective views of the device of the invention with different length round inserts.

Referring to FIGS. 3A, 3B and 3C, there is shown the round set 21 of mold inserts, with each insert 25, 27 and 29 of round end shape, but of varying lengths. As shown in FIG. 3A, there is a round mold insert 29 configured with an elongated length. The insert 29 is shown in position for insertion into the arcuate cavity 37 of arcuate retainer 40 of frame member 12. In FIG. 3B, there is shown a round mold insert 27 configured with a medium length. In FIG. 3C, there is shown a round mold insert 25 configured with a small length.

Figures 4A, 4B, 4C:
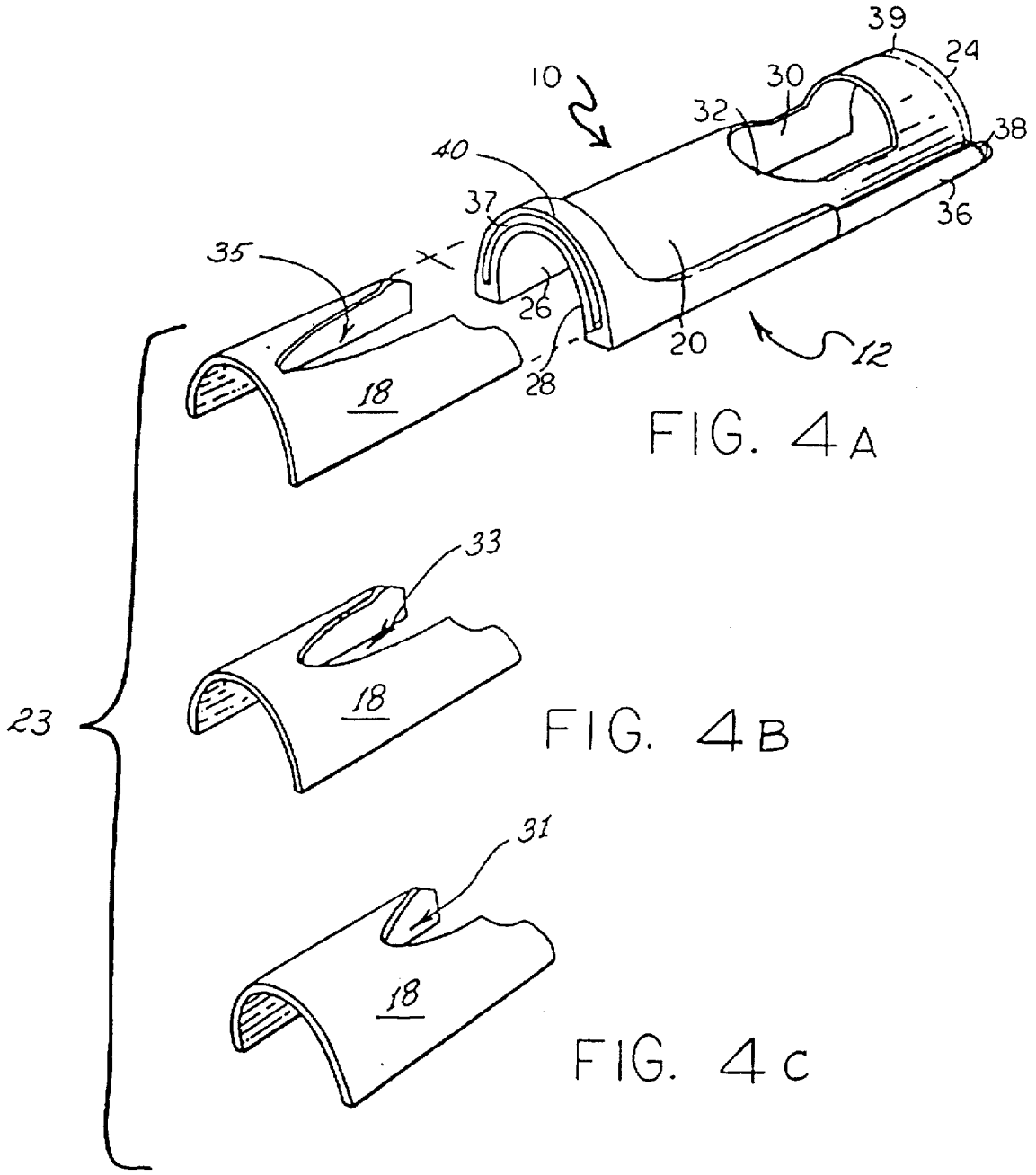
FIGS. 4A, 4B and 4C are perspective views of the device of the invention with different length oval inserts.
Figure 5A:
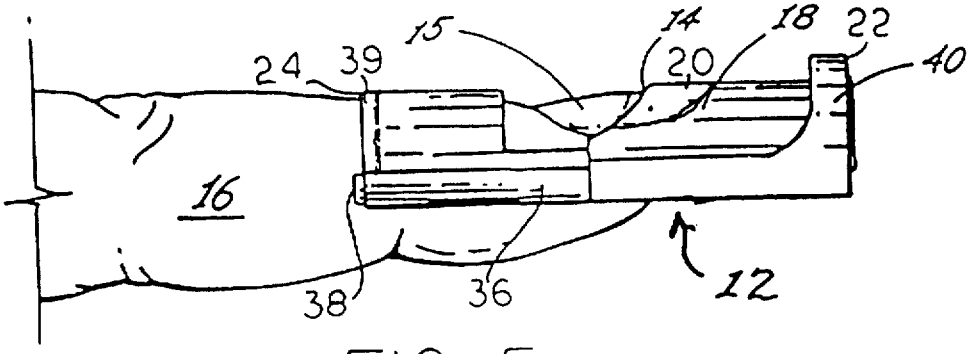
FIG. 5A is a side plan view of the invention of FIG. 1 showing a mold insert fully inserted.
Figure 5B:
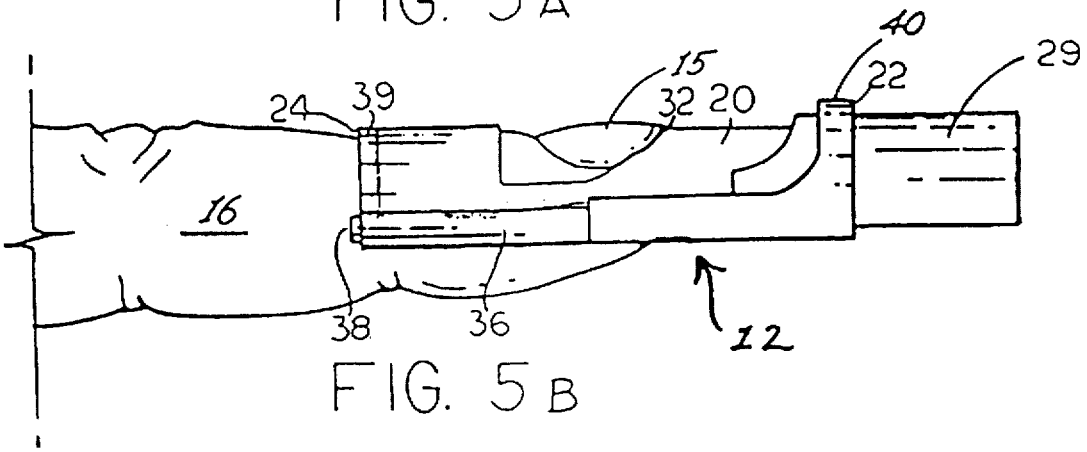
FIG. 5B is a side plan view of the invention of FIG. 1 showing a mold insert partially inserted.

Referring to FIGS. 4A, 4B and 4C, there is shown the oval set of mold inserts 23, composed of an insert body 18 with each insert of oval end shape, but of varying lengths. As shown in FIG. 4A, there is shown an oval mold insert 35 configured with an elongated length. The insert 35 is shown in position for insertion into the arcuate cavity 37 of arcuate retainer 40 of frame member 12. In FIG. 4B, there is shown an oval mold insert 33 configured with a medium length. In FIG. 4C, there is shown an oval mold insert 31 configured with a small length.

The frame member 12 and the various insert sets 21 and 23 may vary in dimensions and composition. For example, the frame 12 is typically arcuate-shaped and may be preformed or formed by the user to conform to and about the upper portion of the digit (finger) 16 to which nail polish is to be applied. The frame member 12 may comprise a thin plastic, arcuate, premolded material or a thin paper foil or plastic material with a stiffening wire 38 about a portion, along the sides, or a substantial part of the arcuate periphery 39 to permit user preshaping and forming to conform and be retained in use on the selected digit.

The insert sets 21 and 23 may assume varying design openings at the end and be so arranged to be slidably clipped or adhesively retained and inserted into one cavity end of the frame 12 to form the reservoir 14 of desired shape and length. The insert sets 21 and 23 may be composed of thin plastic, foil or paper sufficiently sturdy and thick to be slidably inserted and adjusted in position or may be adhesively secured in position by an underlying, self-adhesive layer on the insert. The frame 12 device may contain an underlying self-adhesive layer. The preferred embodiment as illustrated employs a reusable, preformed plastic frame 12 with inexpensive, disposable, slidable insert sets 21 and 23.

Referring to FIGS. 2, 5A, 5B, 6A and 6B, the frame member 12 generally comprises an arcuate base 20 and integrally formed thereto, a distal portion 22, a rear portion 24, and side portions 26 and 28. The frame member 12 further comprises a window aperture 30 formed as part of and in the arcuate base 20. The window aperture 30 includes a front edge 32 of generally semicircular shape, or other desired shape. The frame member 12 further comprises cavities 34 and 36 integrally formed to side portions 26 and 28, respectively. Cavities 34 and 36 extend substantially half the length of the frame member 12 and each cavity contains the user shaping or forming wire 38 disposed therein, so that the user may, by finger pressure, press the wire 38 to conform the thin base 20 about the user's finger. Optional arcuate forming wire may also extend (as shown in broken line) about or within a cavity on the opposite end 24 of the base 20.

Figure 6A:
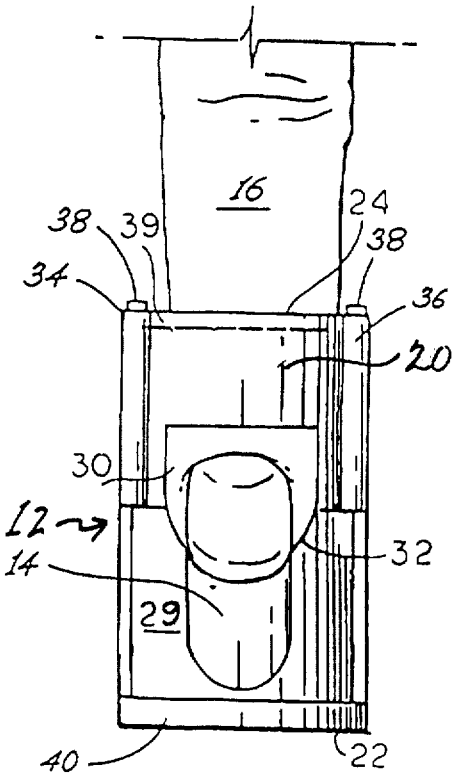
FIG. 6A is a top plan view of the assembled device shown in FIG. 3A.
Figure 6B:
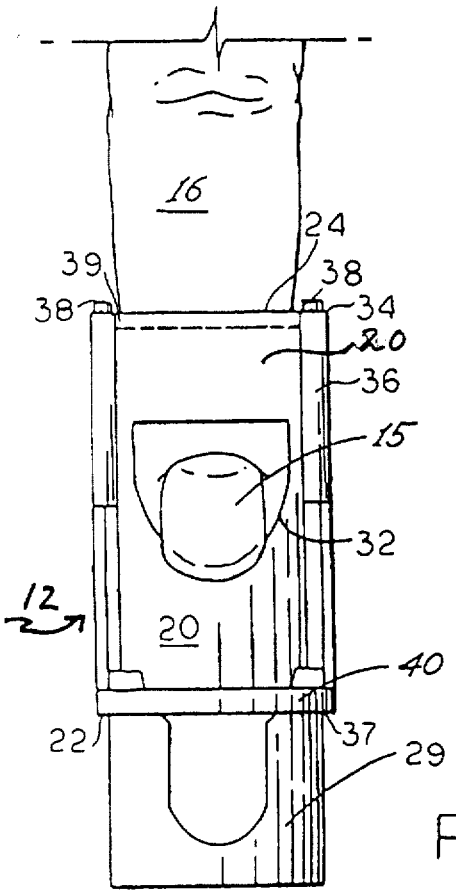
FIG. 6B is a top plan view of the assembled device shown in FIG. 3B.

As shown in FIG. 6A, frame member 12 further comprises an arcuate retainer 40 disposed at the distal portion 22. The arcuate retainer 40 is adapted to secure and/or hold a mold insert selected from either round set 21 or oval set 23, shown in FIGS. 1 and 2 as round insert 29, on frame member 12 in a selected position. The retainer 40 includes an arcuate cavity 37 spaced a distance above arcuate base 20. As shown in FIGS. 1–4A, arcuate base 20 is of substantially semicircular shape. However, in the preferred embodiment, the frame member 12 is made from a user malleable material, such that the arcuate base 20 of the frame member 12 maybe easily deformed to fit and retain the shape or contour of a person's finger 16. In the preferred embodiment, the frame member 12 is made from conventional plastic molding processes and is formed as one integral piece. Also, the frame member 12 is provided with a form-biasing member comprising a wire 38, shown in FIG. 4A, to be pressed together on both sides, and a wire 39 to extend over the rear portion 24 of the frame, which wire may be deformed to fit the user's finger.

Figure 7:
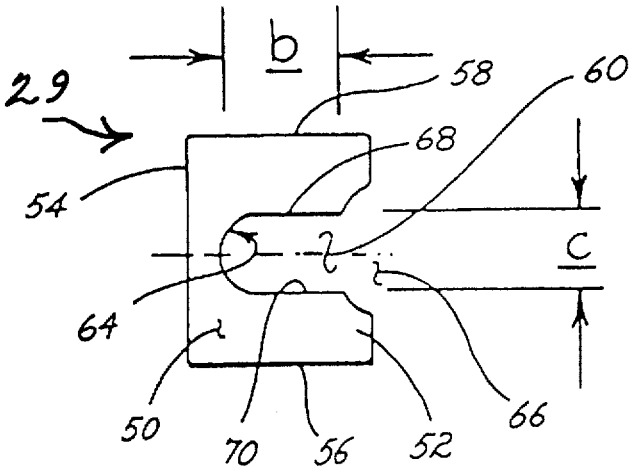
FIG. 7 is a top plan view of the mold insert of the invention shown in FIG. 1.

Referring to FIG. 7, showing mold insert 29, each mold insert generally comprises an upper surface 50, a front portion 54, a rear portion 52 and side portions 56 and 58. Each mold insert further comprises a recess 60 formed as part of the upper surface 50. The recess 60 may be of a variable length b and a width c and defined by a front edge 64 which may be of variable shape (see FIGS. 3A, 3B, 3C, 4A, 4B and 4C), an open rear portion 66, and side edges 68 and 70. Referring to FIGS. 3A, 3B, 3C, 4A, 4B and 4C, recess 60 maybe varied in configuration, for example, from a round shape to an oval shape and with varying area.

In operation, a person's finger 16 is slidably inserted beneath window aperture 30 of the frame member 12, whereby the front edge 32 of window aperture 30 is in contact with the end of the person's finger 16 and arcuate base 20 is resting on the the nail 15. The forming wires 38 and 39 are deformed to fit the shape of the user's finger. Thereafter, the mold insert 29 is passed between the arcuate retainer 40 and the arcuate base 20 through arcuate cavity 37 and slid along the arcuate base 20, until the rear portion 52 of the mold insert 29 is in contact with the end of the person's finger 16, whereby a reservoir 14 is formed for application of the nail-forming composition 13.

The invention further includes a method for forming a sculptured artificial nail 17 on nail 15, which artificial nail 17 can thereafter optimally be shaped to the desired configuration. The method comprises providing an artificial nail coating composition 13 of liquid composition, hardenable to form a hard substance, and providing a frame apparatus 12 configured to be mounted on a finger 16 of a user adjacent a finger nail 15. The frame apparatus 12 includes having an arcuate base 20 for engaging said finger, characterized by a window aperture 30 for surrounding said finger nail and adapted to associate with one of insert sets 21 or 23 of mold inserts for selectively forming an artificial nail of variable configuration. The method includes using at least one mold insert wherein the mold insert is of curved configuration, and is slidably mounted in the end of the frame in engagement with arcuate retainer 40 configured to associate with window aperture 30 to form an elongated reservoir 14 for receiving said artificial nail coating composition superimposed on said nail of user.

The method further includes selecting one mold insert of said set of mold inserts and sliding a person's finger 16 beneath the window aperture 30 of the frame member 12 whereby the edge of said window aperture is in contact with the end of the person's finger 16 and the nail 15 is resting on arcuate base 20. The method includes passing the selected mold insert between said arcuate retainer and the arcuate base and sliding the insert along said arcuate base until the end of the mold insert is in contact with the end of the person's finger, whereby said reservoir 14 is formed. The method comprises depositing artificial nail coating composition 13 in said formed reservoir or well and permitting the nail coating to harden to form a preformed, smooth, uniform, continuous layer of artificial nail upon curing of said applied composition.

What is claimed is:

1. A device for forming an artificial finger nail of selected dimensions by an artificial nail coating composition on a natural finger nail, which device comprises:

a) a frame means having a first end and a second end and including an arcuate base having sides and arranged and constructed to fit in a snug, retaining relationship about the end of a finger of an user;

b) said base characterized by a window aperture of selected dimensions in a section near said second end of said frame means for surrounding said natural finger nail and extending outwardly therefrom;

c) guide means at said first end of said frame means to receive and support an insert means therein;

d) an insert means for controlling the contour and shape of the artificial nail to be formed, said insert means arranged and constructed to be slidably received and supported in said guide means in association with said window aperture to form a reservoir of selected dimensions to receive the artificial nail coating composition; and e) wire forming means in the arcuate base to permit the user to mold said arcuate base by finger pressure of the user about the finger.

2. The device of claim 1 wherein said arcuate base comprises a thin malleable plastic material which may be formed about the finger nail by the finger pressure of the user.

3. The device of claim 1 wherein said guide means includes an arcuate-shaped cavity therein to receive and support the insert means.

4. The device of claim 1 wherein said insert means comprises an insert means selected from a plurality of a set of separate inserts of selected length and end dimensions.

5. The device of claim 1 wherein said wire forming means includes forming wires extending on either lower side of said base toward said second end.

6. The device of claim 1 wherein said insert means comprises a generally rectangular sheet material in selected arcuate form for longitudinal, slidable movement in a relationship with said frame means, said insert means having a first closed end and a second open end to define an elongated space with generally parallel sides extending inwardly from said second open end and having a rounded or oval end.

7. The device of claim 6 wherein said insert means comprises a thin, disposable sheet material malleable by the user to form an arcuate form for use with said frame means.

8. The device of claim 1 wherein said guide means includes a cavity means extending inwardly from said first end of said frame means to receive said insert means, which insert means slidably extends inwardly over a portion of said window aperture to define said reservoir.

9. The device of claim 8 wherein the cavity means comprises an arcuate shaped cavity of said first end of the frame means.

10. The device of claim 1 wherein said frame means comprises a premolded plastic material and said insert means comprises a thin, disposable insert material.

11. The device of claim 1 wherein said wire forming means includes an arcuate-shaped forming wire extending about the periphery of the arcuate base toward said second end.

12. The device of claim 11 wherein said wire forming means includes forming wires on either lower side of said base toward said second end.

13. The device of claim 1 wherein there are a plurality of said insert means of various selected dimensions.

14. In combination, a device for forming an artificial finger nail of selected dimensions by an artificial nail coating composition on a natural finger nail, which device comprises:

a) a frame means having a first end and a second end and including an arcuate base having sides and arranged and constructed to fit in a snug, retaining relationship about the end of a finger of a user;

b) said base characterized by a window aperture of selected dimensions in a section near said second end of said frame means for surrounding said natural finger nail and extending outwardly therefrom;

c) guide means at said first end of said frame means to receive and support an insert means therein;

d) a plurality of insert means for controlling the contour and shape of the artificial nail to be formed, each of said insert means arranged and constructed to be slidably received and supported in said guide means in association with said window aperture to form a reservoir of selected dimensions to receive the artificial nail coating composition; said plurality of said insert means of various selected dimensions;

e) wire forming means in the arcuate base to permit the user to mold said arcuate base by finger pressure of the user about the finger; and f) an artificial nail coating composition to form a sculptured nail.

15. A device for forming an artificial finger nail of selected dimensions by an artificial nail coating composition on a natural finger nail, which device comprises:

a) a frame means having a first end and a second end and including an arcuate base arranged and constructed to fit in a snug, retaining relationship about the end of a finger of an user;

b) said base characterized by a window aperture of selected dimensions in an upper section near said second end of said frame means for surrounding said natural finger nail and extending outwardly therefrom;

c) guide means at said first end of said frame means to receive and support an insert means therein;

d) insert means for controlling the contour and shape of said artificial nail to be formed, said insert means arranged and constructed to be slidably received and supported in said guide means in association with said window aperture to form a reservoir of selected dimensions to receive the artificial nail coating composition;

e) an arcuate base comprising a thin malleable material and including a forming wire means in said arcuate base to permit the user to mold said arcuate base to be formed by finger pressure of the user about the finger;

f) frame means at said first end which includes an arcuate-shaped cavity therein to receive and support said insert means; and g) said insert means comprising a plurality of separate inserts of selected and length and end dimensions.

16. A method of forming an artificial finger nail of selected dimensions and shapes by an artificial nail coating composition on a natural finger nail, which method comprises:

a) employing a frame means with an arcuate base to mount on and to engage about a finger, said base having a window aperture with a first and second end, extending outwardly from one end of the natural nail and with said first end of said aperture inserted between said finger and nail;

b) slidably positioning a selected insert means in an arcuate form into a similar arcuate-shaped guide-receiving cavity at said first end of said frame means and longitudinally adjusting the position of said insert means to form a reservoir of selected shape by the selection of the insert means and of selected length by said adjusting; and c) applying a hardenable liquid nail composition to said reservoir and hardening said composition to form an artificial nail.

17. The method of claim 16 which includes slidably positioning said insert means in said frame means, to form said reservoir.

18. The method of claim 16 which includes selecting said insert means from a set composed of a plurality of separate inserts of selected length and shape.

19. The method of claim 16 which includes employing a wire forming means in a malleable frame means at said one end mounted about the finger and employing finger pressure to form and shape said arcuate base into an engaging relationship with the finger.

20. A device for forming an artificial finger nail of selected dimensions by an artificial nail coating composition on a natural finger nail, which device comprises:

a) a frame means having a first end and a second end and including an arcuate base arranged and constructed to fit in a snug, retaining relationship about the end of a finger of a user;

b) said base characterized by a window aperture of selected dimensions in a section near said second end of said frame means for surrounding said natural finger nail and extending outwardly therefrom;

c) guide means at said first end of said frame means to receive and support an insert means wherein; and d) an insert means for controlling the contour and shape of the artificial nail to be formed, said insert means arranged and constructed to be slidably received and supported in said guide means in association with said window aperture, to form a reservoir of selected dimensions to receive the artificial nail coating composition;

and wherein said insert means comprises a generally rectangular sheet material in selected arcuate form for longitudinal, slidable movement in a relationship with said frame means, said insert means having a first closed end and a second open end to define an elongated space with generally parallel sides extending inwardly from said second open end and having a rounded or oval end.

21. The device of claim 20 which includes a wire forming means in the arcuate base to permit the user to mold said arcuate base by finger pressure of the user about the finger.

22. The device of claim 20 wherein said insert means comprises an insert means selected from a set composed of a plurality of separate inserts of selected length and end dimensions.

23. The device of claim 20 wherein said guide means includes a cavity means extending inwardly from said first end of said frame means to receive said insert means, which insert means slidably extends inwardly over a portion of said window aperture to define said reservoir.

24. The device of claim 20 wherein there are a plurality of said insert means of various selected dimensions.

25. A method of forming an artificial finger nail of selected dimensions and shapes by an artificial nail coating composition on a natural finger nail, which method comprises:

a) employing a frame means with an arcuate base to mount on and to engage about a finger, said base having a window aperture with a first and second end, extending outwardly from one end of the natural nail, and with said first end of said aperture inserted between said finger and nail;

b) employing a wire forming means in a malleable frame means at said one end, mounted about the finger, and employing finger pressure to form and shape said arcuate base into an engaging relationship with the finger;

c) positioning a selected insert means over said first end of said window aperture of said frame means to form a reservoir of selected shape and length; and d) applying a hardenable liquid nail composition to said reservoir and hardening said composition to form an artificial nail.

26. The method of claim 25 which includes selecting said insert means from a set composed of a plurality of separate inserts of selected length and shape.

27. The method of claim 25 which includes slidably positioning said insert means in an arcuate form into a similar arcuate-shaped, guide-receiving cavity at said end of said frame means.

* * * * *